United States Patent [19]

Hunter et al.

[11] Patent Number: 4,898,332

[45] Date of Patent: Feb. 6, 1990

[54] ADJUSTABLE ROTARY STREAM SPRINKLER UNIT

[75] Inventors: Edwin J. Hunter, 5551 Codorniz Rd., Rancho Sante Fe, Calif. 92067; Loren W. Scott, Carlsbad, Calif.

[73] Assignee: Edwin J. Hunter, Rancho Santa Fe, Calif.

[21] Appl. No.: 335,848

[22] Filed: Apr. 10, 1989

Related U.S. Application Data

[63] Continuation-in-part of Ser. No. 121,400, Nov. 11, 1987, Pat. No. 4,842,201, which is a continuation-in-part of Ser. No. 878,591, Jun. 26, 1986, Pat. No. 4,869,379.

[51] Int. Cl.[4] ..... B05B 3/04; B05B 1/26

[52] U.S. Cl. ..... 239/240; 239/396; 239/520; 239/581.1

[58] Field of Search ..... 239/DIG. 9, 240, 242, 239/396, 231, 520, 518, 581.1

[56] References Cited

U.S. PATENT DOCUMENTS

| | | | |
|---|---|---|---|
| 2,674,494 | 4/1954 | Metteson et al. | 239/520 |
| 3,854,664 | 12/1974 | Hunter | 239/240 X |
| 4,353,506 | 10/1982 | Hayes | 239/231 X |
| 4,353,507 | 10/1982 | Kah | 239/240 |

FOREIGN PATENT DOCUMENTS

| | | | |
|---|---|---|---|
| 204796 | 10/1923 | United Kingdom | 239/520 |

*Primary Examiner*—Andres Kashinkow
*Assistant Examiner*—Kevin P. Weldon
*Attorney, Agent, or Firm*—Baker, Maxham, Jester & Meador

[57] ABSTRACT

A rotary stream sprinkler unit comprises a body having a water flow passage in which is disposed a flow control unit having a variable restriction in a passage to one or more arcuate passages configured to control the volume and pressure of a primary stream delivered to a rotary distributor head rotatably mounted at the outlet of the housing for dividing each primary stream into a plurality of final streams and rotating each of the final streams through a selected arc during the rotation of the rotary head.

22 Claims, 3 Drawing Sheets

FIG. 2
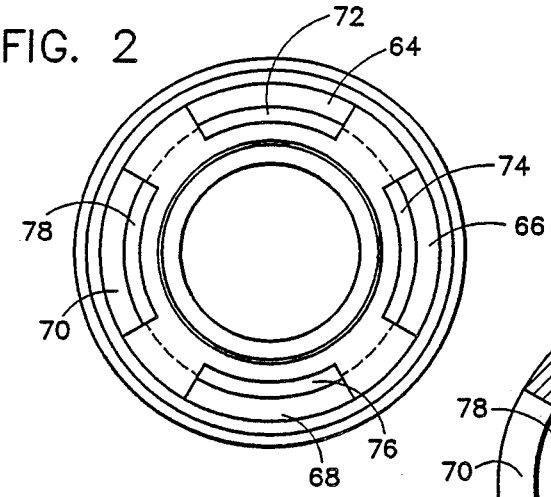
FIG. 3
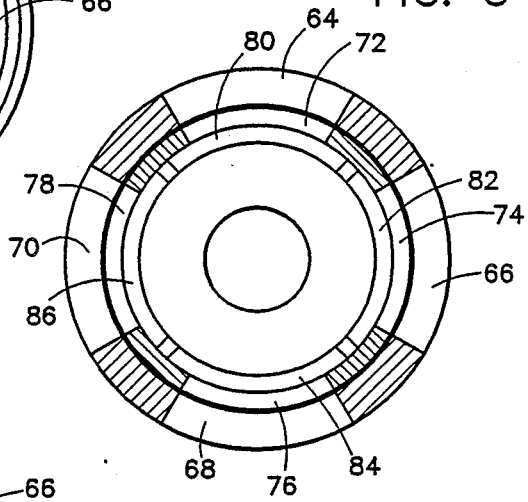
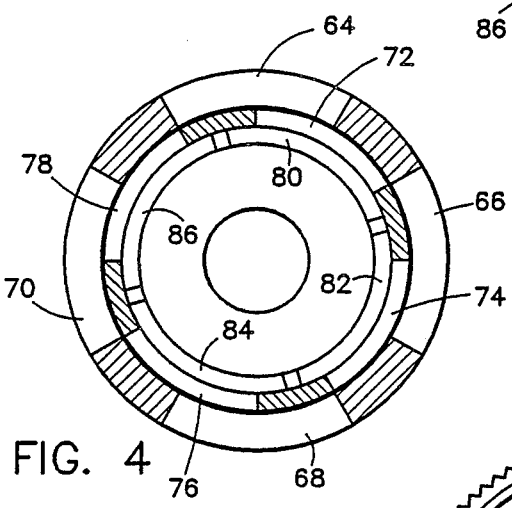
FIG. 4
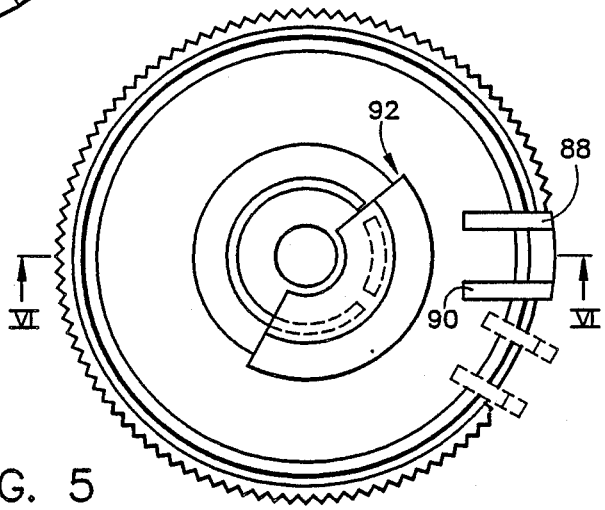
FIG. 5

FIG. 6
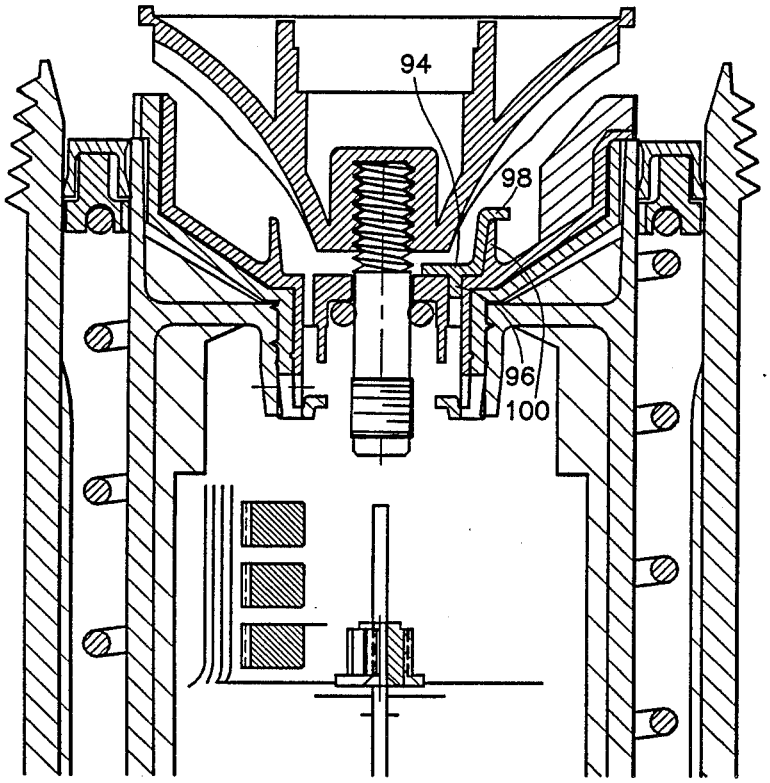
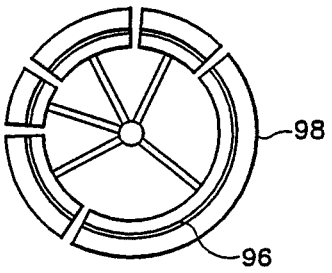
FIG. 7

ADJUSTABLE ROTARY STREAM SPRINKLER UNIT

REFERENCE TO RELATED APPLICATION

This is a continuation-in-part of co-pending application Ser. No. 121,400, filed Nov. 11, 1987, now U.S. Pat. No. 4,842,201 entitled "ROTARY STREAM SPRINKLER UNIT", of co-inventor Edwin J. Hunter, which was a continuation-in-part of co-pending application Ser. No. 878,591, filed June 26, 1986, now U.S. Pat. No. 4,867,379 entitled "ROTARY STREAM SPRINKLER UNIT", of Edwin J. Hunter.

BACKGROUND OF THE INVENTION

The present invention relates to sprinkler units, and pertains particularly to a rotary stream sprinkler unit.

In U.S. Pat. No. 3,854,664, issued Dec. 17, 1974, to Edwin J. Hunter, and entitled "SPRINKLER SYSTEMS", there is disclosed a sprinkler unit which has a rotating head that directs a plurality of rotating streams over an area to be watered. In that prior device, the streams of water are formed in nozzles in the rotating head. The rotating head has inlets to the nozzle on one end, which engages and cooperates with an orifice plate for acting as a valve for controlling communication of pressurized water to the nozzles.

U.S. Pat. No. 4,471,908, issued Sept. 18, 1984, to Edwin J. Hunter, and entitled "PATTERN SPRINKLER HEAD" discloses a similar sprinkler unit having V-shaped nozzles in a cylindrical rotating head. The nozzle inlet openings cooperate with an orifice in an orifice plate providing a valve action to vary the nozzle openings to the source of pressurized water. This combination delivers streams of water of variable length and volume from the nozzles in the distributor head. The orifice opening in the plate defines the spray pattern to be produced by the streams issuing from the nozzles in the rotating head.

Among the problems of the prior device is that sand and grit from the water supply gets on the orifice plate and rapidly wears the plate and seals of the unit. In some instances, the sand and grit can cause the unit to stall. These and other problems of the prior device have prevented it from being satisfactory.

In co-pending application Ser. No. 878,591, filed June 26, 1986, of Edwin J. Hunter, entitled "ROTARY STREAM SPRINKLER UNIT", there is disclosed a sprinkler unit, that is an improvement of the aforementioned patents, that utilizes an axially spaced open channel head for forming and directing the streams. It also utilizes specially configured passages or nozzles to form and control each of the streams to the channels in the head. It has been found that the passages are subject to plugging due to particles of sand, flakes and the like in the water.

In a second co-pending application Ser. No. 121,400, filed Nov. 6, 1987, entitled "ROTARY STREAM SPRINKLER UNIT", of Edwin J. Hunter, there is disclosed a sprinkler unit, that is an improvement of that disclosed in the aforementioned co-pending application, both of which are allowed and are incorporated herein by reference as though fully set forth. The second of the aforementioned applications discloses a sprinkler unit that utilizes an axially spaced open channel head and specially configured arcuate passages or nozzles to form and control each of the streams to the channels in the head for controlling area and amount of coverage. This embodiment also reduces some of the clogging problems associated with some of the other embodiments. However, it has been found that thirty-six different nozzle inserts are required to provide the consumer with his normal requirements as to arc and area of coverage. We have devised modifications that enable this requirement to be met with four different inserts.

Accordingly, it is desirable that an improved rotary stream sprinkler unit be available.

SUMMARY AND OBJECTS OF THE INVENTION

It is therefore the primary object of the present invention to provide an improved rotary stream sprinkler unit.

In accordance with the primary aspect of the present invention, a rotary stream sprinkler unit comprises a housing, having one or more arcuate stream passages or nozzles shaped to reduce the likelihood of blockage and to provide selected area and volume coverage, with adjustable means for providing a predetermined stream volume and velocity, with an open channel rotor positioned at the outlet of the flow passages for dividing the stream into a plurality of individual streams and selectively distributing the streams over a predetermined area.

Another aspect of the invention includes inserts for selectively controlling the arc of coverage of a sprinkler unit.

BRIEF DESCRIPTION OF THE DRAWINGS

The above and other objects and advantages of the present invention will become apparent from the following description when read in conjunction with the drawings wherein:

FIG. 2 is a view taken generally on line II—II of FIG. 1;

FIG. 3 is a view in section taken on line III—III of FIG. 1;

FIG. 4 is a view like FIG. 3 in another position of adjustment;

FIG. 5 is a view taken on line V—V of FIG. 1;

FIG. 6 is a view like FIG. 1 showing an orifice restricting insert in position; and FIG. 7 is a top plan view of a plurality of orifice plugs.

DETAILED DESCRIPTION OF A PREFERRED EMBODIMENT

Figure 1:
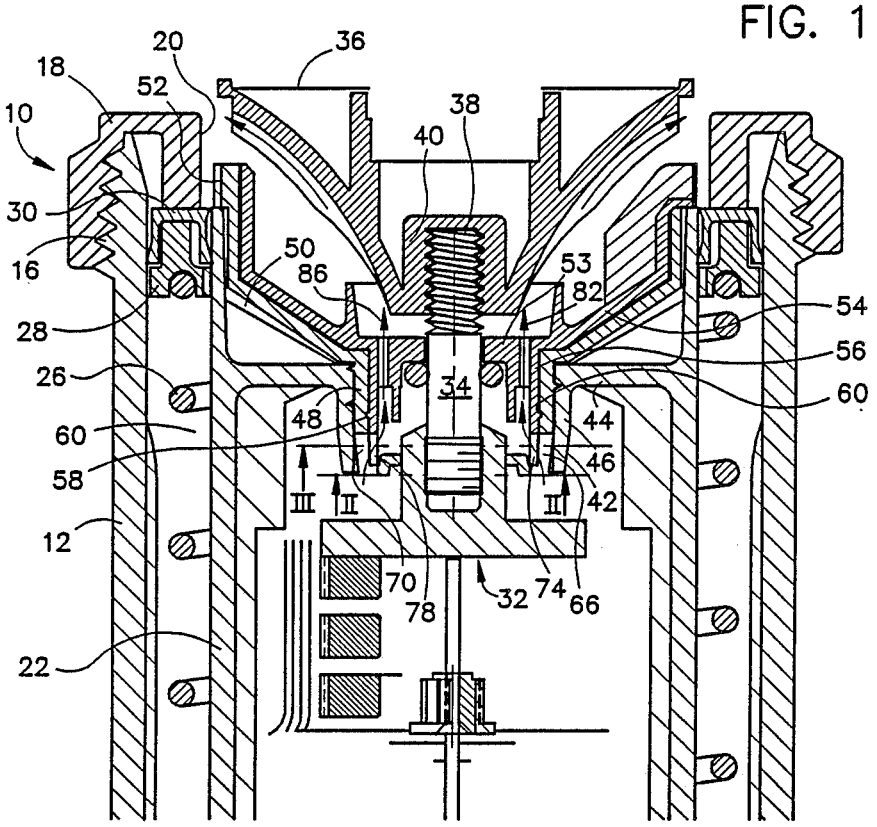
FIG. 1 is a partial side elevation view in section of a sprinkler unit in accordance with the invention.

Referring to FIG. 1 of the drawings, there is illustrated a sprinkler unit constructed in accordance with a preferred embodiment of the invention. The sprinkler unit, designated generally by the numeral 10, comprises an elongated generally cylindrical tubular main or outer housing 12, having a threaded inlet port (not shown) at the lower axial end, which shall be termed the inlet end attachable to a suitable source of water under pressure, such as a riser.

The opposite or upper end of the housing is open and is considered the outlet end thereof. The outlet end is provided with annular threads 16 for receiving a retainer cap 18, for retaining an inner pop up housing as will be explained. The cap 18 has a central bore 20 for accommodating the telescopic extension of an inner tubular housing 22, which is telescopically and reciprocably mounted within the housing 12 for extension upward to an operative position and retraction to a non-operative position by means or a spring, as illustrated in FIG. 1.

The inner housing 22 includes a radially extending flange (not shown) at the lower end thereof, which extends outward and engages the interior surface of the wall of the outer housing 12, and also serves as a retainer for a retracting spring 26, which biases at its lower end against the flange and its upper end against an annular ring 28. The ring 28 seats against a cup-shaped annular seal 30, which engages and seals against the outer surface of the inner housing 22.

The necessary driving and flow control structure for the sprinkler unit is mounted within the inner housing 22, and carried therewith as the housing is extended upward into the operative position. This includes, for example, a turbine responsive to water flow through the housing for driving a gear train 32 for driving a shaft 34, which drives a rotary distributor head 36. The drive shaft 34 has a threaded outer end 38, which extends and threads into a bore 40 in the center of the distributor head 36.

The shaft 38 extends coaxilly along the housing through a bore in a flow control unit to be described, having a one or plurality of flow control passages or nozzles therein which control the shape and volume of water flowing to the distributor head 36. The flow control unit is detachably mounted in a tubular extension 42 of an inner extending wall or bulkhead 44 of the inner housing 22. The tubular extension 42 includes a threaded bore 46, which is threadably engaged by a threaded cylindrical surface of a sleeve or tubular extension 48 of an outer generally cone or funnel shaped insert.

The flow control unit comprises an outer cone or funnel shaped member threadably mounted in the upper end of the housing, as described above, and an inner cone or funnel shaped member which mounts in the outer member for limited rotation.

These members will be hereinafter referred to generally as cones for the sake of simplicity, and the specific central tubular or central extensions thereof will be referred to as sleeves. The outer cone comprises a sleeve 48, which threadably engages into the bore of member 42, as explained, and an upper bowl portion 50 with a knurled or serrated rim 52. The rim 52 enables the unit to be threadably mounted within the housing by hand. The threaded rim portion has an arcuate slot formed therein, as will be subsequently explained, for receiving a portion of the inner cone.

The inner cone comprises an upper bowl portion 54, which conforms generally to the curvature of bowl 50, with an inner hub 55 having an axially extending sleeve 56 which is rotatably mounted within the sleeve 48. These two members are rotatably mounted by means of a snap fitting annular ridge 58 and groove 60, which retains the inner sleeve 56 within the outer sleeve 48 and permits rotation thereof.

Water flowing through the housing to the distributor head flows along a passageway defined by portions of the housing itself and a plurality of passages formed in the flow control unit, which controls the volume and configuration of a stream of water fed to the distributor head. The passages through the flow control unit include a plurality of slots or windows 64, 66, 68 and 70 formed in the lower end of the outer sleeve 48, as more clearly illustrated in FIG. 2. These slots or openings are matched to similar size openings 72, 74, 76 and 78 formed in the inner sleeve, which permit the water to flow into the interior of the inner sleeve and axially therealong to flow through a plurality of orifices 80, 82, 84 and 86, as described and claimed for example in Hunter's prior U.S. application pointed out above. These orifices shape and form the stream of water, which is then fed onto the distributor head 36, which distributes it according to the pattern which will be determined by the shape of the orifice. In addition, the distance that the streams from the distributor travel will be determined by the flow of water through the flow control unit.

As shown in FIGS. 2 and 3, when the inner sleeve is in the angular position as shown, the passages 64, 72, etc. are fully open for full open flow. However, when the inner sleeve is rotated such that the windows 72, etc. of the inner sleeve are non-aligned with the openings 64, etc. of the outer sleeve, the flow of water through the flow control is restricted. This results in a decrease in the reach of the streams from the distributor head. The arrangement as illustrated provides for an infinite adjustment, such that for a particular application the reach of the unit is infinitely adjustable for a range for example between twenty feet and twenty-eight feet. In the illustrated arrangement, the rotation of the inner sleeve results in a one-half closing of the channel opening to the orifices 80-86.

Referring to FIG. 5, the inner cone or sleeve is rotatable between the fully open position, as shown, to a one-half closed position as shown in phantom. As illustrated, the outer sleeve rim is provided with a slot or opening through which the inner sleeve rotates. The inner sleeve is provided with a tool receiving member 90, which receives a tool for applying the torque for rotation of the inner cone or sleeve.

Referring to FIGS. 5, 6 and 7, additional inserts are provided for selectively establishing the arc for the distributing head. It should be noted that the orifice assemblies are provided in ninety degree, one-hundred eighty degree, two-hundred seventy degree, and three-hundred sixty degree units. That illustrated herein is a three-hundred sixty degree unit, such that with no insert the coverage around the distributor head will be in a three-hundred sixty degree full circle coverage. The shape of the area covered, however, may be altered in a manner as taught and covered in Hunter's prior application Ser. No. 121,400, filed Nov. 6, 1987.

The orifice assembly can then be altered by the provision of a plurality of inserts (FIG. 7), which in the illustrated embodiment are preferably fifteen degree, thirty degree, forty-five degree, sixty degree and nine-five degree plugs, which have a configuration as shown for example in FIGS. 5 and 6. These may be provided as a unit, as shown in FIG. 7, wherein all five (5) plugs are molded at once and included with each sprinkler unit. The appropriate plug can then be torn off and inserted in the orifice as needed or desired.

The plug unit has a semi-circular lower disc portion 94 from which depends an arcuate plug portion 96 for extending into the orifice of the inner sleeve. Each plug includes an upward extending arcuate portion 98 extending upward and over the edge of a cylindrical extension 100 of the bowl of the inner cone. This enables the plug to be grasped and removed or inserted as desired. The use of the plug results in blocking off the respective portion of the arcuate orifices to provide selective arcs of coverage by the sprinkler unit. This combination of arrangement as illustrated and described enables the provision of four orifice units, with plug assemblies to enable the custom assembly and adjustment of approximately thirty-six different combinations of arc and distance of coverage.

This invention enables a dealer or distributor to stock quantities of four fully assembled sprinkler units for sale to the customer. The customer selects a quantity of units with the desired coverage or that can be easily modified by the insertion of a plug to give the desired coverage. The distance of coverage is essentially infinite between the minimum and maximum limits for a particular PSI of water supply.

The rotating distributor head directs the streams of water by way of a plurality of flow channels radially outward from the sprinkler unit and rotates the streams through an arc. The flow control unit is provided with one or more arcuate shaped passages or nozzles that have a greater width than height, and variations in height in order to provide certain desired coverage, as disclosed in the aforementioned pending applications.

The present sprinkler unit, as described above, is designed to distribute streams of water throughout a selected area. For example, the sprinkler unit has the capability, with the appropriate orifice and nozzle configuration, of distributing streams of water over an area having substantially any desired shape. The sprinkler unit may be positioned in the center of the area covered or to one side thereof. The unit accomplishes this by means of the flow control passages, which which form the nozzles that controls the volume and velocity of each primary flow stream, such that the final streams have a particular reach. The distributing head has the capability of forming a plurality of final streams and directing or sweeping each stream across a particular arc or area of the plot.

The outer surface of the head in which the channels are formed is slightly curved in extending from a substantially axial direction at the apex or inlet end to a direction on the order of about fifty-five degrees thereto at the base or outlet end. The water channel includes an inlet end and an outlet end with sloped side walls extending, from a minimum depth at the inlet end to a maximum depth at about one-third to about one-half the length thereof up to the outlet. The arc or curvature of the channels outward from the axis aids in confining the water to the channels and forcing it into a stream in the channel. The channels each curve outward in a common plane with the axis of the distributor head.

The distributor head, as can be seen in FIG. 1, sits directly over and is axially spaced from the flow control unit, and the inner or lower ends of the channels are disposed directly over the outlet of the flow passages. The non-engagement of the distributor head with the flow control unit eliminates the problem of high wear and binding, as in the prior art units.

In operation, a sprinkler unit is selected having the proper orifice in the flow control unit to cover the desired area, i.e., part circle or full circle. The flow control unit is selected to have the proper flow passage and orifice cross-section for supplying the primary flow stream, with the appropriate cross-section or thickness of stream at the proper positions around the orifice to provide the necessary flow to the rotor. The rotor picks up a portion of the primary stream, with each channel which forms and directs a plurality of final streams outward in proportion to the water supplied thereto. The amount of water supplied to a particular channel at any one time depends on the cross-section of the orifice at that position and the rotary position of the inner sleeve. A channel will pick up an amount of water equal to its width and the height of the passage or orifice at the channel position. Therefore, the amount of water feeding or forming the final stream will increase or decrease as the passage changes in thickness along its arc.

While we have illustrated and described our invention by means of specific embodiments, it is to be understood that numerous changes and modifications may be made therein without departing from the spirit and scope of the invention as defined in the appended claims.

We claim:

1. A rotating stream sprinkler unit comprising:
a tubular housing having a central axis, an inlet, an outlet, and a flow passage communicating therebetween for conducting a stream of water from said inlet to said outlet;
orifice means at said outlet for receiving and forming said stream of water into at least one substantially arcuate primary stream directed axially outward from said outlet; and
a rotating distributor head rotatably mounted at and spaced axially outward from said outlet having a plurality of flow channels therein for receiving and forming said primary stream into a plurality of streams and directing said plurality of streams outward from said axis over a predetermined area; and
means for selectively blocking a portion of said flow passage for selectively adjusting the quantity of water in said stream of water communicated to said distributor head.

2. A rotary stream sprinkler according to claim 1 wherein:
said means for selectively blocking said passage comprises a sleeve rotatably mounted in said housing and means on said sleeve for selectively restricting said flow passage.

3. A sprinkler unit according to claim 2 wherein:
at least part of said flow passage is formed in said sleeve and is responsive to rotation of said sleeve for restricting the flow therein from the inlet to the outlet thereof.

4. A sprinkler unit according to claim 2 wherein:
said orifice means for forming said stream of water comprises at least one substantially arcuate flow passage in said sleeve disposed in a circular arc and extending along said sleeve parallel to said central axis toward said outlet.

5. A sprinkler unit according to claim 4 wherein:
means for inserting in said arcuate passage at the outlet thereof for selectively adjusting the arcuate coverage thereof.

6. A sprinkler unit according of claim 1 wherein:
said orifice means comprises a sleeve detachably mounted in said housing; and
an arcuate passage formed in and extending along said sleeve.

7. A sprinkler unit according to claim 6 wherein:
at least part of said flow passage is formed in said sleeve and is responsive to rotation of said sleeve for restricting the flow therein from the inlet to the outlet thereof.

8. A sprinkler unit according to claim 7 wherein:
said flow channels on said distributor head are open channels.

9. A sprinkler unit according to claim 8 wherein:
said passage is shaped at the outlet thereof for providing a substantially rectangular distribution pattern.

10. A sprinkler unit according to claim 9 further comprising:
a substantially cone shaped housing means covering said open channels of said distributing head.

11. A rotary stream sprinkler unit comprising:
an elongated generally cylindrical housing having coaxially disposed inlet and outlet means at opposite ends thereof;
a flow passage in said housing for communicating a fluid flow from said inlet to said outlet;
orifice means at said outlet of said housing for generating at least one generally arcuate thin wide flow stream directed axially outward at said outlet thereof; and
a rotating distributor head having a plurality of open stream channels disposed axially outward from said outlet for receiving and directing said flow stream in a plurality of streams over selected areas; and
means in said flow passage for adjustably restricting the flow therein.

12. A rotary stream sprinkler according to claim 11 wherein:
said orifice means comprises a sleeve detachably mounted in said housing; and
said arcuate passage formed in and extending along said sleeves.

13. A sprinkler unit according to claim 12 wherein:
at least part of said flow passage is formed in said sleeve and is responsive to rotation of said sleeve for restricting the flow therein from the inlet to the outlet thereof.

14. A sprinkler unit according of claim 13 wherein:
means for inserting in said arcuate passage at the outlet thereof for selectively blocking a portion of said passage for adjusting the arcuate coverage thereof.

15. A sprinkler unit according to claim 13 wherein:
said passage is shaped at the outlet thereof for providing a substantially rectangular distribution pattern.

16. A sprinkler unit according to claim 12 wherein:
said flow channels on said distributor head are open channels; and
a substantially cone shaped housing means extends over and covers said open channels of said distributing head.

17. A rotary stream sprinkler unit comprising:
an elongated generally cylindrical housing having coaxially disposed inlet and outlet means at opposite ends thereof;
a flow passage in said housing for communicating a fluid flow from said inlet to said outlet;
orifice means at said outlet of said housing for generating at least one generally arcuate thin wide flow stream directed axially outward at said outlet thereof, said orifice means comprises a sleeve detachably mounted in said housing, and said arcuate passage formed in and extending along said sleeves;
a rotating distributor head having a plurality of open stream channels disposed axially outward from said outlet for receiving and directing said flow stream in a plurality of streams over selected areas; and
means in said flow passage for adjustably restricting the flow therein.

18. A sprinkler unit according to claim 17 wherein:
at least part of said flow passage is formed in said sleeve and is responsive to rotation of said sleeve for restricting the flow therein from the inlet to the outlet thereof.

19. A sprinkler unit according of claim 18 wherein:
means for inserting in said arcuate passage at the outlet thereof for selectively blocking a portion of said passage for adjusting the arcuate coverage thereof.

20. A sprinkler unit according to claim 19 wherein:
said passage is shaped at the outlet thereof for providing a substantially rectangular distribution pattern.

21. A sprinkler unit according to claim 20 wherein:
said flow channels on said distributor head are open channels; and
a substantially cone shaped housing means extends over and covers said open channels of said distributing head.

22. A sprinkler unit according of claim 21 wherein:
said restricted passage varies in cross-section between the ends thereof.

* * * * *